US005653403A

United States Patent [19]

Ritchey

[11] Patent Number: 5,653,403

[45] Date of Patent: Aug. 5, 1997

[54] TOILET PAPER HOLDER AND DISPENSER

[76] Inventor: Eugene B. Ritchey, 13821 Sable Blvd., Brighton, Colo. 80601

[21] Appl. No.: 609,825

[22] Filed: Mar. 1, 1996

[51] Int. Cl.[6] ..... B65H 16/04

[52] U.S. Cl. ..... 242/597.5; 242/597.7; 242/598.1; 242/598.4; 242/598.6

[58] Field of Search ..... 242/597.5, 597, 242/598.1, 598.4, 598.6, 597.1, 597.2, 597.3, 597.4, 597.6, 597.8, 597.7; D6/523

[56] References Cited

U.S. PATENT DOCUMENTS

| | | | |
|---|---|---|---|
| 2,240,109 | 4/1941 | Baldwin et al. | 242/597.3 X |
| 2,523,951 | 9/1950 | Graumlich | 242/597.5 X |
| 2,529,420 | 11/1950 | Ramquist | 242/597.4 |
| 2,555,531 | 6/1951 | Boord . | |
| 2,609,158 | 9/1952 | Bradley | 242/597 X |
| 2,661,165 | 12/1953 | Salmonson | 242/597 X |
| 2,861,751 | 11/1958 | Sarro | 242/597 X |
| 2,994,488 | 8/1961 | Waddell | 242/597.5 |
| 3,022,957 | 2/1962 | Blunt et al. . | |
| 3,227,386 | 1/1966 | Pitcher | 242/597.5 |
| 3,370,805 | 2/1968 | Barbee | 242/597.5 X |
| 3,467,330 | 9/1969 | Yavitch | 242/598.6 X |
| 3,792,822 | 2/1974 | Underhill . | |
| 4,270,706 | 6/1981 | Robinson . | |
| 4,319,687 | 3/1982 | Hull | 242/596.7 |
| 4,416,425 | 11/1983 | Kish . | |
| 4,432,504 | 2/1984 | Pace . | |
| 4,824,038 | 4/1989 | Chandler . | |
| 4,934,625 | 6/1990 | Richardson | 242/597 |
| 5,366,175 | 11/1994 | Schutz . | |

FOREIGN PATENT DOCUMENTS

| | | | |
|---|---|---|---|
| 390620 | 4/1933 | United Kingdom | 242/596.7 |

*Primary Examiner*—Daniel P. Stodola
*Assistant Examiner*—William A. Rivera
*Attorney, Agent, or Firm*—Fields & Johnson, P.C.

[57] ABSTRACT

In a first embodiment, the toilet paper holder and dispenser includes a rod receiving section adapted to receive the dispenser rod of a common toilet paper dispenser. A peg attaches to the rod receiving section and protrudes away therefrom. A stabilizer is also attached to the rod receiving section to prevent the toilet paper holder from undesirably rotating and shifting when toilet paper is dispensed from the roll which is mounted over the peg. In a second embodiment, the peg may be adjustably positioned at a desired vertical angle. In a third embodiment, the toilet paper holder includes a recessed mounting bracket which is directly mountable to the recess formed in the wall which previously had mounted to it the common toilet paper dispenser. For any one of the embodiments, the distal end of the peg may include either a tip portion which is angled or bent away from the longitudinal axis of the peg or may include a retainer or cap to assist in retaining a roll of toilet paper mounted over the peg.

13 Claims, 3 Drawing Sheets

TOILET PAPER HOLDER AND DISPENSER

TECHNICAL FIELD

This invention relates to a device for holding and dispensing a roll of paper, and more particularly, to an improved toilet paper holder and dispenser for holding and dispensing toilet paper therefrom.

BACKGROUND ART

Some prior art devices exist for improving the manner in which rolls of paper such as toilet paper are secured and dispensed.

One example of such a prior art reference is U.S. Pat. No. 4,416,425 to Kish which discloses a paper roll dispenser comprising a bracket having two generally parallel elongated support arms extending therefrom in a direction generally perpendicular to a front face of the bracket such that each support arm is free to rotate about its arm axis. A spindle having one end attached to one of the support arms rotatably supports a roll of paper between the support arms. The roll is replaced by rotating one support arm about its arm axis and thereby moving the spindle into a position projecting generally away from the other support arm whereupon the spent roll supported by the spindle may be replaced.

Another example of a prior art reference is U.S. Pat. No. 3,022,957 to Blunt, et al. This invention includes a roll carrying spindle which is adapted to be swung upwardly and outwardly away from a wall surface to facilitate attachment and removal of a roll of toilet paper mounted thereon.

U.S. Pat. No. 5,366,175 to Schutz discloses an apparatus for dispensing a roll of paper which includes a rotatable shaft having a helical shaped projection on the outer surface thereof which is directly mounted to a base or support structure. A lock arrangement is provided to prevent rotation of the shaft after the roll has been substantially depleted so that end-wise removal of the roll can be manually accomplished.

U.S. Pat. No. 2,555,531 to Boord discloses a toilet paper dispenser comprising a pair of supporting arms extending outwardly from a mounting bracket wherein the outer ends of the supporting arms are bent upwardly to form spaced parallel prongs. Positioned over the prongs are corresponding spindles which each receive a roll of toilet paper mounted thereover.

While the foregoing prior art inventions may be adequate for their intended purposes, one shortfall with each of these inventions is that none of them are intended for use on existing common toilet paper dispensers, such as is found in most bathrooms. That is, each of these references include structure which is not adaptable for use with the common toilet paper dispenser which typically includes a pair of opposing brackets and a rod section or dispenser which is positionable between the brackets and is held in place by means of a spring or the like. Furthermore, none of the prior art references are easily adaptable to provide a paper holder which may be used in bathrooms which have a recess formed in the bathroom wall.

These advantages along with others will be apparent to those skilled in the art as disclosed in the specification and drawings which follow.

DISCLOSURE OF THE INVENTION

In accordance with this invention, a toilet paper holder and dispenser apparatus is provided. In a first embodiment, the apparatus includes a rod receiving section having an opening which is adapted for receiving the common toilet paper dispenser rod found in most bathrooms. Connected to the rod receiving section is a peg which protrudes in a perpendicular fashion away from a longitudinal axis of the opening formed in the rod receiving section. Also attached to the rod receiving section is a stabilizer which prevents the toilet paper holder from undesirably rotating or shifting when toilet paper is dispensed from a roll which is mounted over the peg. The proximal end of the peg includes a stop to limit the travel of the roll of paper over the peg.

In the first embodiment, the distal end of the peg includes a tip portion which is bent or angled away from the longitudinal axis of the peg. This angled tip portion is used to help secure a roll of paper mounted over the peg. In another arrangement, the toilet paper holder includes a retainer which is removably attached to the distal end of the peg in order to secure a roll of paper. The retainer includes a tip portion having a protruding screw wherein the distal end of the peg includes a threaded well for receiving the screw. Alternatively, the retainer may be a cap that snugly fits over the distal end of the peg.

In another embodiment, the apparatus of this invention includes an adjustable peg which may be positioned at a desired angle with respect to the rod receiving section. Accordingly, the rod receiving section may include an adjustable center portion which snugly fits over an internal tube such that the snug fit enables the center portion to be adjusted and remain at a particular angle. Further, a pair of end portions are receivable over the internal tube to help stabilize the positioning of the center portion and to provide a means of attachment for the stabilizer.

In yet another embodiment, the apparatus of this invention may include a recessed bracket resembling a pie plate which may be sized to fit within the recess found in the walls of bathrooms which normally receives a bracket conforming to the exterior shape of a roll of toilet paper. A peg connects to the recessed bracket and protrudes away therefrom so that a roll of paper may be mounted thereover as with the previous embodiments. The peg of this particular embodiment may also include the angled tip portion, retainer or cap for securing a mounted roll of toilet paper.

BEST MODE FOR CARRYING OUT THE INVENTION

Figure 1:
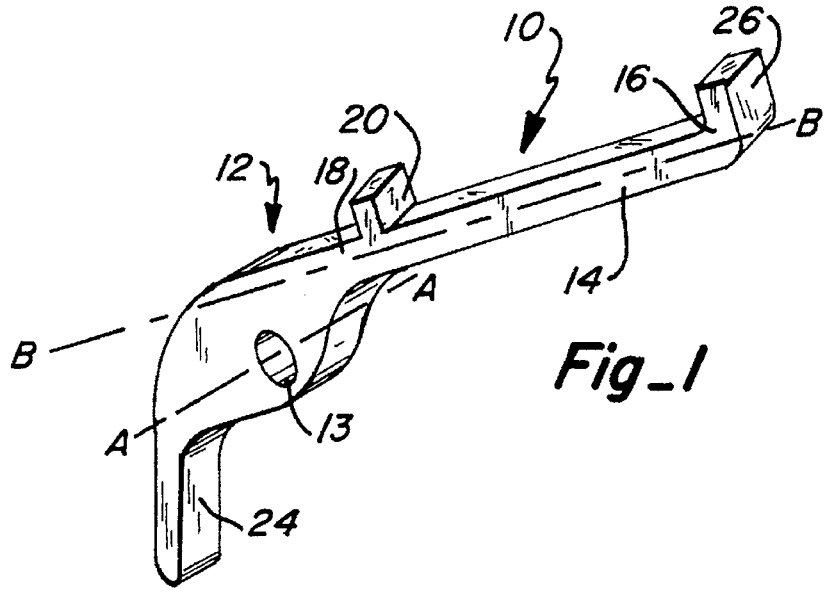
FIG. 1 is a perspective view of a first embodiment of the toilet paper holder and dispenser of this invention.
Figure 2:
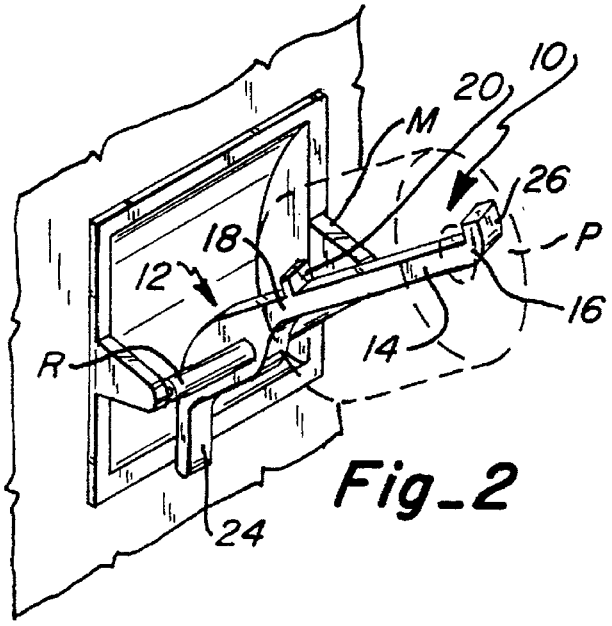
FIG. 2 is a another perspective view of the first embodiment of this invention illustrating a roll of paper mounted over the peg of the toilet paper holder.
Figure 3:
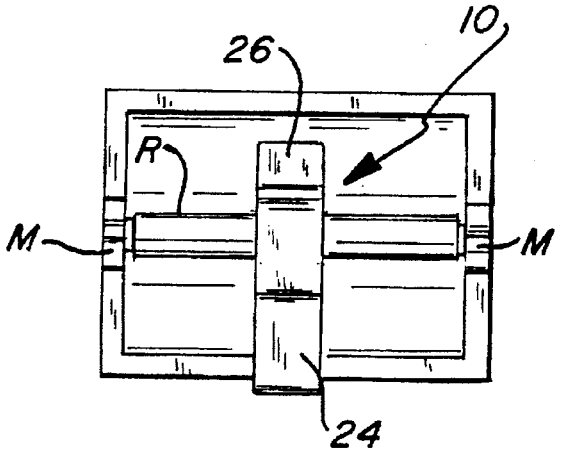
FIG. 3 is a front elevational view of the first embodiment of this invention shown installed with a common toilet paper dispenser of a bathroom.

As shown in FIG. 1, a first embodiment of the toilet paper holder and dispenser apparatus 10 of this invention includes a rod receiving section 12 having an opening 13 extending therethrough for receiving the dispenser rod R of a common toilet paper dispenser. As shown in FIG. 2, the common toilet paper dispenser includes a pair of oppositely positioned mounts M which receive the dispenser rod R which is held between the mounts M as by an internal spring (not shown) mounted within the rod R.

Connected to the rod receiving section 12 is a peg 14 which extends substantially perpendicular from longitudinal axis A—A and which defines the position of opening 13. Proximal end 18 of peg 14 is attached to the rod receiving section 12 and the distal end 16 of peg 14 may terminate with an angled tip portion 26. Tip portion 26 may take the form of an angled extension which extends away from axis B—B which defines the longitudinal axis of peg 14. At the proximal end 18 of peg 14 is attached a stop 20 which may be formed in the same shape as tip portion 26. Attached to the opposite end of rod receiving section 12 is stabilizer 24 which extends below longitudinal axis B—B a predetermined length.

In the first embodiment, in operation, a conventional dispenser rod R, having an internal spring (not shown) to hold it in place, is removed from its mounts M and is inserted through the opening 13 of rod receiving section 12. The stabilizer 24 is positioned so that it extends downwardly from axis A—A of the rod receiving section 12. The dispenser rod R is reattached between mounts M and a roll of toilet paper P is then mounted over the peg 14 such that it is positioned between stop 20 and tip portion 26. Tip portion 26 is sized such that a roll of toilet paper may snugly fit over it; however, the roll is not easily removed because of the natural stability provided the roll of toilet paper positioned between the tip portion 26 and stop 20.

Figure 4:
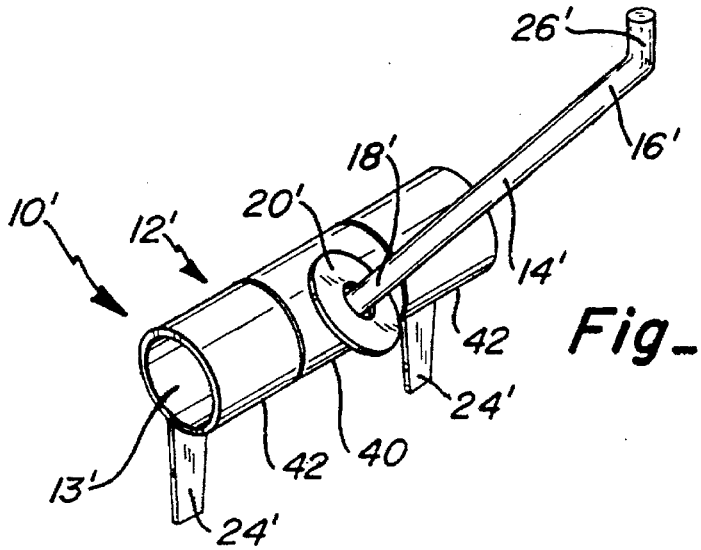
FIG. 4 is a perspective view of a second embodiment of this invention.
Figure 5:
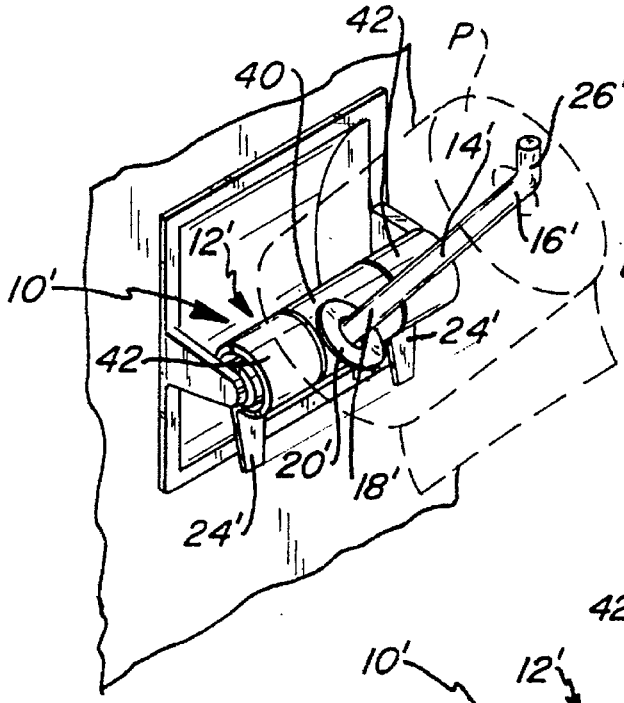
FIG. 5 is another perspective view of the second embodiment of this invention shown installed with a common toilet paper dispenser of a bathroom.
Figure 6:
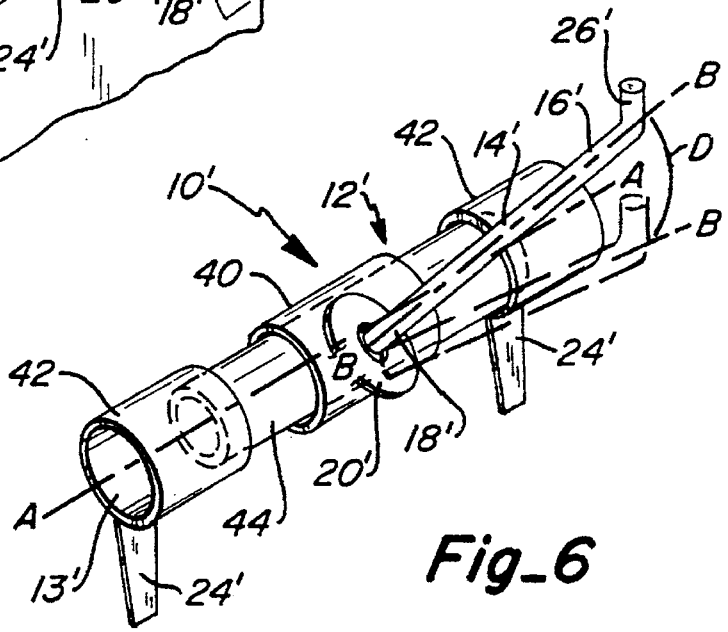
FIG. 6 is a partially exploded perspective view of the second embodiment of this invention illustrating the adjustability of the peg.

In a second embodiment of the apparatus 10' of this invention, as seen in FIGS. 4 through 6, the rod receiving section 12' includes a center portion 40, two end portions 42 and an internal tube 44. As with the first embodiment, the second embodiment also includes a peg 14' having a proximal end 18' and a distal end 16'. As best seen in FIG. 6, center portion 40 fits over internal tube 44. The diameter of the opening in the center portion 40 is such that it snugly fits over internal tube 44. This snug fit enables center portion 40 to be adjustably rotated over internal tube 44 so that the peg 14 can be positioned to extend away from internal tube 44 at a desired angle D. Once internal tube 44 has been inserted through the opening in center portion 40, end portions 42 may be slipped over respective opposite ends of internal tube 44. One or both of the end portions 42 may include a stabilizer 24'. In operation, the dispenser rod R may be inserted through opening 13' and a roll of toilet paper may be installed over the tip portion 26' wherein the roll is securely positioned between stop 20' and tip portion 26'. According to the needs of the user, peg 14' may be adjusted to the desired angle D.

Figure 7:
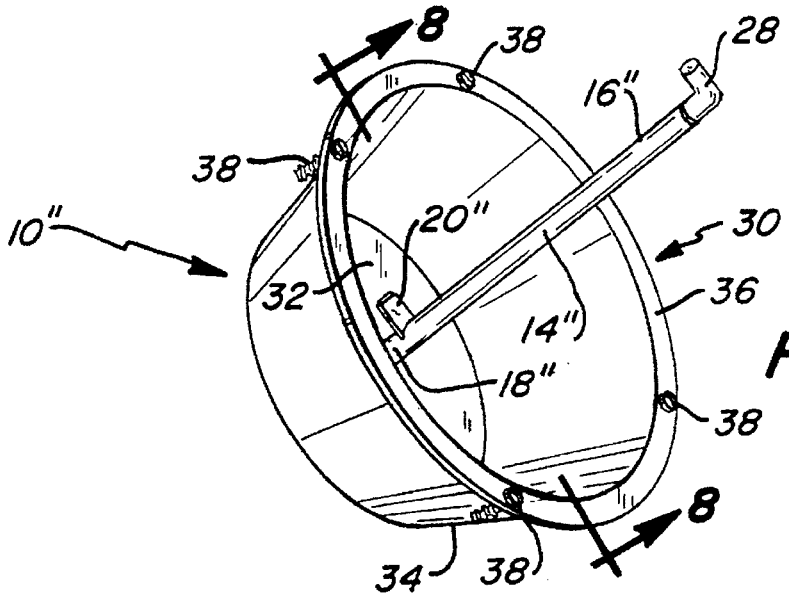
FIG. 7 is a perspective view of a third embodiment of this invention.
Figure 8:
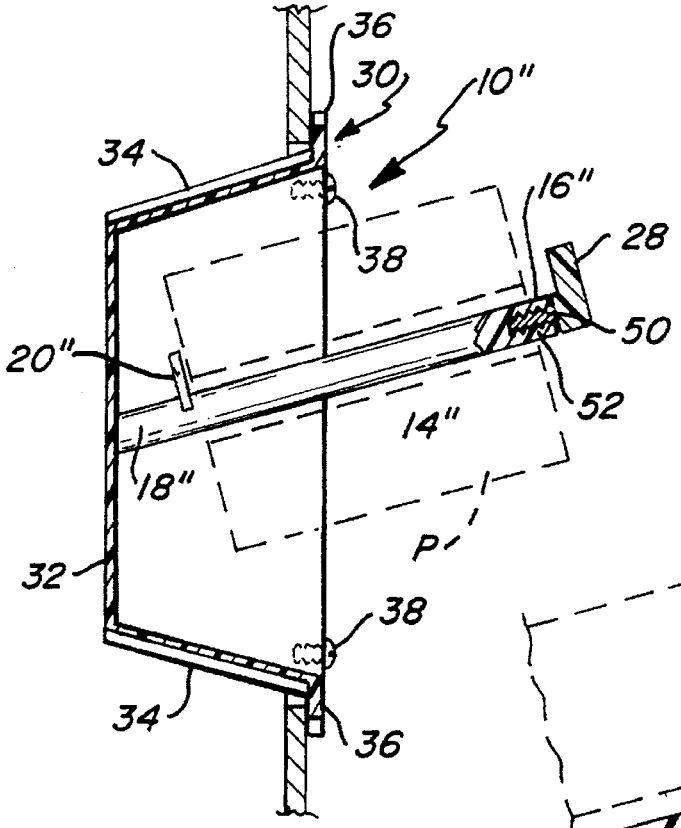
FIG. 8 is an enlarged vertical section taken along Line 8—8 of FIG. 7 illustrating the third embodiment of this invention.

In yet a third embodiment of this invention, as shown in FIGS. 7 and 8, the apparatus 10" of this invention may include a recessed mounting bracket 30 which attaches to the proximal end 18" of peg 14". In this embodiment, rod receiving section 12 and stabilizer 24 are eliminated and replaced therewith by recessed mounting bracket 30. This embodiment is used when the entire common toilet paper dispenser apparatus is removed from the bathroom wall, thus leaving an opening or recess therein. Accordingly, recessed mounting bracket 30 is sized so that it fits within the recess of the wall. Recessed mounting bracket 30 includes a plate portion 32 and a connecting cylindrical sidewall 34 which is inserted in and conformable to the recess in the wall. Circular attachment flange 36 connects to the free end of the cylindrical sidewall 34. The third embodiment of the device 10" is attached to the wall by means of a plurality of fasteners or screws 38 which are placed through holes drilled in attachment flange 36.

For the third embodiment, in operation, once the recessed mounting bracket 30 has been installed within the recess of the wall as by fasteners or screws 38, a roll of toilet paper P may be mounted over the peg 14" between the distal end 16" and proximal end 18" thereof wherein the bottom surface of paper P rests against stop 20. Retainer 28 may then be placed in engagement with a distal end 16" of the peg 14". Retainer 28 may include a bolt portion 50 which is insertable within peg 14" to engage internal threads 52.

Figure 9:
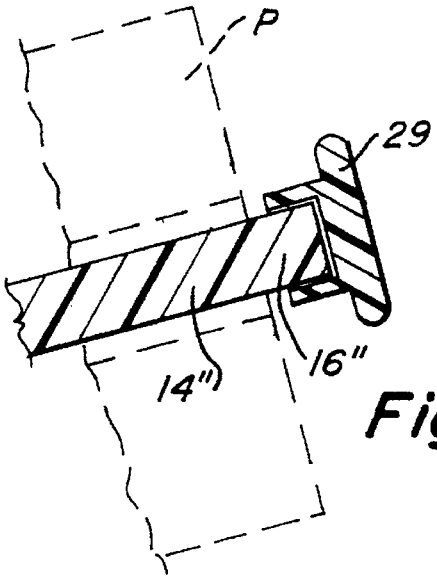
FIG. 9 is an enlarged partial vertical cross section of an alternate distal end arrangement of the peg for either the first, second, or third embodiments of this invention.

Alternatively, as shown in FIG. 9, instead of utilizing a tip portion 26 or retainer 28, a cap 29 may be directly attached to the distal end 16" of peg 14". Accordingly, cap 29 snugly fits over the distal end 16" of peg 14" to secure the roll of paper P.

Common to each of the embodiments is that structure is provided for dispensing a roll of paper wherein the free end of the paper may be more easily found and, therefore, the toilet paper may be more easily and efficiently dispensed. Furthermore, it has been found in elderly persons and physically challenged persons that dispensing paper from a roll is accomplished more easily by this invention because the position of the mounted roll of paper itself assists in tearing away a desired length of paper. That is, because the roll of paper is mounted so that the free end of the paper is hung at an angle with respect to the floor, it is easier to tear the paper along its perforations which are generally cut in a transverse direction with respect to the length of the roll. Also, since means are provided for adjusting the particular angle of the protruding peg, the roll of paper may be most advantageously positioned according to the particular needs of each individual user.

This invention has been described in detail with reference to some preferred embodiments thereof, but it will be understood that various other modifications can be effected within the spirit and scope of this invention.

I claim:

1. A toilet paper holder and dispenser apparatus mounted to a dispenser rod secured to a wall, said apparatus comprising:

a rod receiving section including an opening formed therethrough receiving the rod, said opening defining a first longitudinal axis, said apparatus being pivotable about the rod when mounted thereto;

a peg having proximal and distal ends, said proximal end integral with said rod receiving section and said distal end extending substantially perpendicular and away from said first longitudinal axis, said distal end of said peg being insertable through a central opening in a roll of toilet paper; and a stabilizer adapted to abut the wall, said stabilizer integral with said rod receiving section limiting the pivoting movement of said apparatus when the roll of paper is mounted over said peg.

2. An apparatus, as claimed in claim 1, wherein:

said peg extends along a second longitudinal axis and said distal end of said peg includes a tip section which extends away from said second longitudinal axis to assist in removably retaining the roll of paper mounted thereover.

3. An apparatus, as claimed in claim 1, further including:

a retainer attached to said distal end of said peg for removably retaining the roll of paper mounted over said peg.

4. An apparatus, as claimed in claim 1, further including:

a stop attached to said proximal end of said peg for providing support to an adjacent edge of the roll of paper as it is positioned when mounted over said peg.

5. An apparatus, as claimed in claim 1, further including:

means integral with said peg for adjusting said peg at a desired vertical angle.

6. An apparatus, as claimed in claim 1, further including:

a cap attached to said distal end of said peg for removably retaining the roll of paper mounted over said peg.

7. A toilet paper holder and dispenser apparatus comprising:

means for mounting a dispenser rod to a support surface:

means for receiving the rod including an opening formed therethrough, said apparatus being pivotable about said rod when mounted thereto;

means integral with said receiving means for removably securing a roll of paper mounted thereover, said securing means including a distal end for receiving the roll of paper; and means integral with said receiving means for limiting the pivoting movement of said apparatus when the roll of paper is mounted over said securing means.

8. An apparatus, as claimed in claim 7, further including:

means attached to said distal end of said securing means for retaining the roll of paper mounted thereover.

9. An apparatus, as claimed in claim 7, further including:

means integral with said securing means for adjusting said securing means at a desired vertical angle.

10. A toilet paper holder and dispenser apparatus adaptable for installation within a recess formed in a wall, said toilet paper holder and dispenser apparatus comprising:

a recessed mounting bracket having a sidewall and a plate portion positionable within the recess of the wall;

a peg having proximal and distal ends, said proximal end connected to said recessed mounting bracket and said distal end extending substantially perpendicular to said recessed mounting bracket for receiving a roll of paper over said peg;

said peg further includes a longitudinal axis and said distal end includes a removable member attached thereto which extends away from said longitudinal axis to assist in retaining the roll of paper mounted thereover; and a stop attached to said proximal end of said peg for providing support to an adjacent edge of the roll of paper as it is positioned when mounted over said peg and wherein the stop supports the adjacent edge so that it lies in separation from said plate portion of said recessed mounting bracket.

11. An apparatus, as claimed in claim 10, wherein:

said removable member is a retainer including a bolt portion.

12. An apparatus, as claimed in claim 10, wherein:

said removable member is a cap.

13. A toilet paper holder and dispenser apparatus adapted to be installed into a recess formed in a wall, said toilet paper holder and dispenser apparatus comprising:

means for mounting said toilet paper holder to the wall including means for conforming to the recess in the wall;

means connected to said mounting means for removably securing a roll of toilet paper mounted thereover, said securing means including proximal and distal ends;

means attached to said distal end of said securing means for retaining the roll of toilet paper mounted thereover; and a stop attached to said proximal end of said securing means for providing support to an adjacent edge of the roll of toilet paper as it is positioned when mounted over said securing means and wherein the stop supports the adjacent edge so that it lies in separation from said conforming means of said mounting means.

* * * * *

UNITED STATES PATENT AND TRADEMARK OFFICE

CERTIFICATE OF CORRECTION

PATENT NO. : 5,653,403

DATED : August 5, 1997

INVENTOR(S) : Eugene B. Ritchey

It is certified that error appears in the above-identified patent and that said Letters Patent is hereby corrected as shown below:

Column 4, line 19, delete "20" and insert --20"--.

Signed and Sealed this

Fourteenth Day of April, 1998

Bruce Lehman

*Attest:*

BRUCE LEHMAN

*Attesting Officer*

*Commissioner of Patents and Trademarks*